US005918554A

United States Patent [19]

Rassamni

[11] Patent Number: 5,918,554

[45] Date of Patent: Jul. 6, 1999

[54] CREDIT CARD SECURITY DEVICE

[76] Inventor: Aj Rassamni, 1575 Willowbrook La., Simi Valley, Calif. 93065

[21] Appl. No.: 09/041,254

[22] Filed: Mar. 12, 1998

[51] Int. Cl.[6] ..... E05G 1/00

[52] U.S. Cl. ..... 109/29; 109/45; 70/63

[58] Field of Search ..... 109/29, 33, 34, 109/45, 47, 59 R; 70/63

[56] References Cited

U.S. PATENT DOCUMENTS

| | | | |
|---|---|---|---|
| 3,934,434 | 1/1976 | Law | 70/63 |
| 3,988,909 | 11/1976 | Catapano | 70/63 |
| 4,187,703 | 2/1980 | Ippoliti | 70/63 |
| 4,580,422 | 4/1986 | Wills | 70/63 |
| 4,649,723 | 3/1987 | Appelbaum | 70/63 |
| 4,722,435 | 2/1988 | Mareels et al. | 109/33 X |
| 4,804,826 | 2/1989 | Hertzen | 235/382 |
| 4,853,676 | 8/1989 | Kitts | 109/33 X |
| 4,884,502 | 12/1989 | Levy | 102/293 |
| 4,942,831 | 7/1990 | Tel | 109/29 |
| 5,196,828 | 3/1993 | Keniston | 109/29 X |
| 5,388,433 | 2/1995 | Anderson et al. | 109/29 X |
| 5,485,143 | 1/1996 | Keniston | 109/29 X |
| 5,528,998 | 6/1996 | Smith | 70/63 X |
| 5,617,799 | 4/1997 | Kaczorowski | 109/29 |
| 5,722,332 | 3/1998 | Fumanelli | 109/45 |

*Primary Examiner*—Suzanne Dino Barrett

[57] ABSTRACT

A new credit card security device for securely housing credit cards and identification. The inventive device includes a housing having a generally rectangular configuration. The housing has an open upper end, a closed lower end, a wide front face, a wide rear face and opposed narrow side faces. The housing is dimensioned for receiving credit cards and identification cards therein. The open upper end has a cover hingedly secured to a back edge thereof. The cover is defined by an open lower end, a closed upper end, a front face, a rear face and opposed side faces. An ink filled membrane is disposed interiorly of the housing and the cover. The membrane is disposed along the front faces, the rear faces, and the opposed side faces of the housing and the cover.

1 Claim, 2 Drawing Sheets

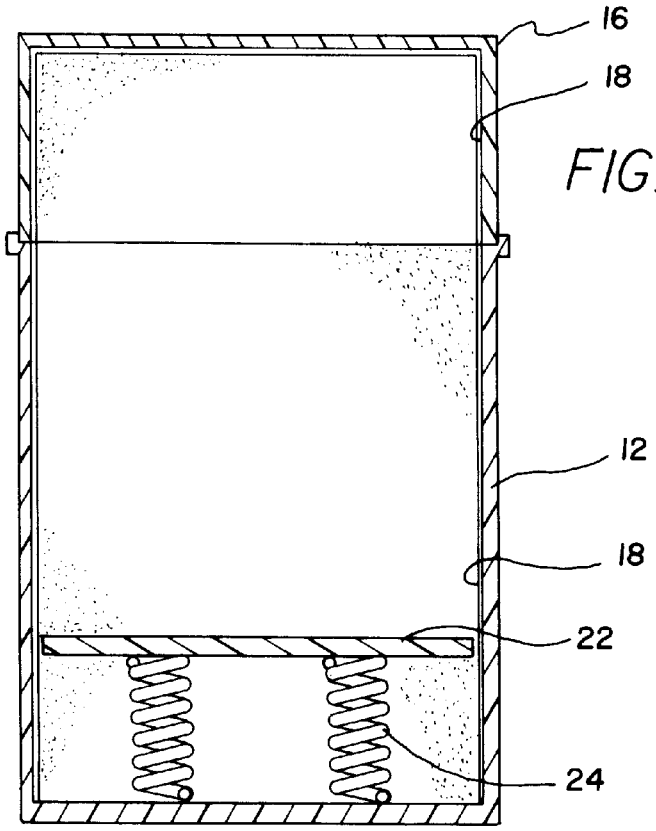
FIG.3
FIG.4
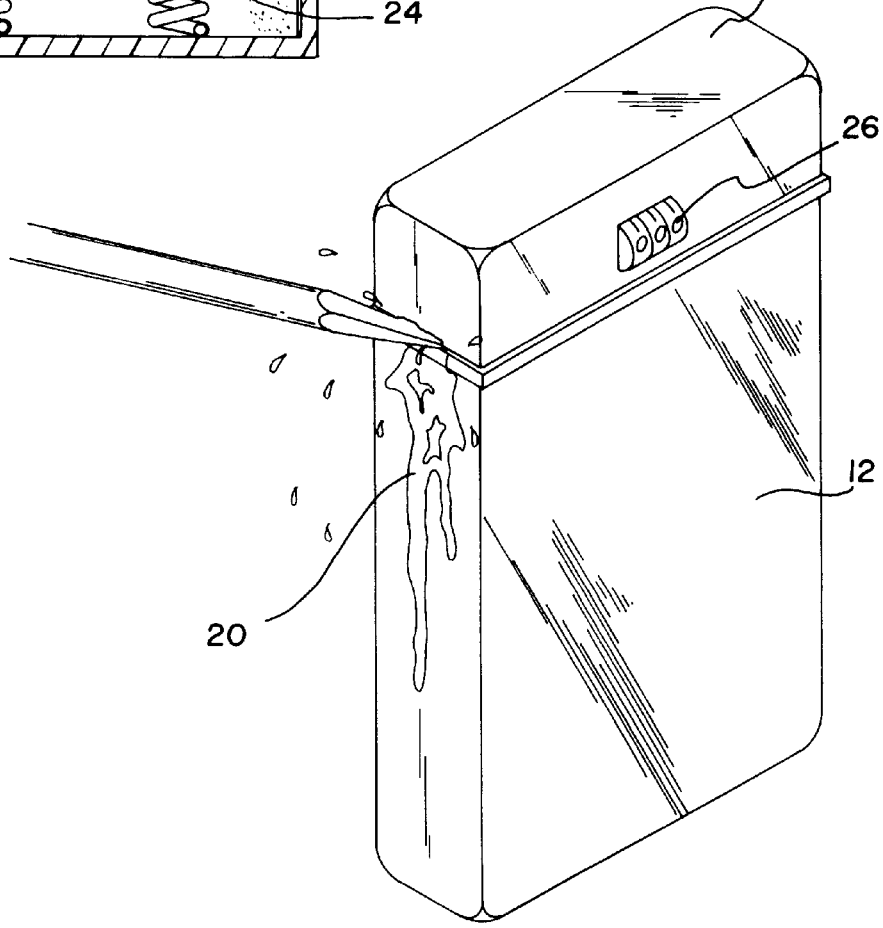

CREDIT CARD SECURITY DEVICE

BACKGROUND OF THE INVENTION

1. Field of the Invention

The present invention relates to security devices and more particularly pertains to a new credit card security device for securely housing credit cards and identification.

2. Description of the Prior Art

The use of security devices is known in the prior art. More specifically, security devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art security devices include U.S. Pat. No. 4,804,826 to Hertzen et al.; U.S. Pat. No. 4,853,676 to Kitts; U.S. Pat. No. Des. 339,232 to Chen; U.S. Pat. No. 4,884,507 to Levy; U.S. Pat. No. 4,722,435 to Marcels et al.; and U.S. Pat. No. 4,942,831 to Tel.

While these devices fulfill their respective, particular objectives and requirements, the aforementioned patents do not disclose a new credit card security device. The inventive device includes a housing having a generally rectangular configuration. The housing has an open upper end, a closed lower end, a wide front face, a wide rear face and opposed narrow side faces. The housing is dimensioned for receiving credit cards and identification cards therein. The open upper end has a cover hingedly secured to a back edge thereof. The cover is defined by an open lower end, a closed upper end, a front face, a rear face and opposed side faces. An ink filled membrane is disposed interiorly of the housing and the cover. The membrane is disposed along the front faces, the rear faces, and the opposed side faces of the housing and the cover.

In these respects, the credit card security device according to the present invention substantially departs from the conventional concepts and designs of the prior art, and in so doing provides an apparatus primarily developed for the purpose of securely housing credit cards and identification.

SUMMARY OF THE INVENTION

In view of the foregoing disadvantages inherent in the known types of security devices now present in the prior art, the present invention provides a new credit card security device construction wherein the same can be utilized for securely housing credit cards and identification.

The general purpose of the present invention, which will be described subsequently in greater detail, is to provide a new credit card security device apparatus and method which has many of the advantages of the security devices mentioned heretofore and many novel features that result in a new credit card security device which is not anticipated, rendered obvious, suggested, or even implied by any of the prior art security devices, either alone or in any combination thereof.

To attain this, the present invention generally comprises a housing having a generally rectangular configuration. The housing has an open upper end, a closed lower end, a wide front face, a wide rear face and opposed narrow side faces. The housing is dimensioned for receiving credit cards and identification cards therein. The open upper end has a cover hingedly secured to a back edge thereof. The cover is defined by an open lower end; a closed upper end, a front face, a rear face and opposed side faces. An ink filled membrane is disposed interiorly of the housing and the cover. The membrane is disposed along the front faces, the rear faces, and the opposed side faces of the housing and the cover. A lifting platform is slidably disposed interiorly of the housing. The platform has a pair of springs secured to a lower surface thereof. Free ends of the springs are secured to the closed lower end of the housing. A combination lock is disposed within the front face of the cover. The combination lock has a corresponding latch member secured to and extending upwardly from the open upper end of the housing for selectively engaging the combination lock to preclude opening of the cover member with respect to the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new credit card security device apparatus and method which has many of the advantages of the security devices mentioned heretofore and many novel features that result in a new credit card security device which is not anticipated, rendered obvious, suggested, or even implied by any of the prior art security devices, either alone or in any combination thereof.

It is another object of the present invention to provide a new credit card security device which may be easily and efficiently manufactured and marketed.

It is a further object of the present invention to provide a new credit card security device which is of a durable and reliable construction.

An even further object of the present invention is to provide a new credit card security device which is susceptible of a low cost of manufacture with regard to both materials and labor, and which accordingly is then susceptible of low prices of sale to the consuming public, thereby making such credit card security device economically available to the buying public.

Still yet another object of the present invention is to provide a new credit card security device which provides in the apparatuses and methods of the prior art some of the advantages thereof, while simultaneously overcoming some of the disadvantages normally associated therewith.

Still another object of the present invention is to provide a new credit card security device for securely housing credit cards and identification.

Yet another object of the present invention is to provide a new credit card security device which includes a housing having a generally rectangular configuration. The housing has an open upper end, a closed lower end, a wide front face, a wide rear face and opposed narrow side faces. The housing is dimensioned for receiving credit cards and identification cards therein. The open upper end has a cover hingedly secured to a back edge thereof. The cover is defined by an open lower end, a closed upper end, a front face, a rear face and opposed side faces. An ink filled membrane is disposed interiorly of the housing and the cover. The membrane is disposed along the front faces, the rear faces, and the opposed side faces of the housing and the cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is cross-sectional view of the present invention.

FIG. 4 is a perspective view of the present invention illustrating the safety feature thereof.

DESCRIPTION OF THE PREFERRED EMBODIMENT

Figure 1:
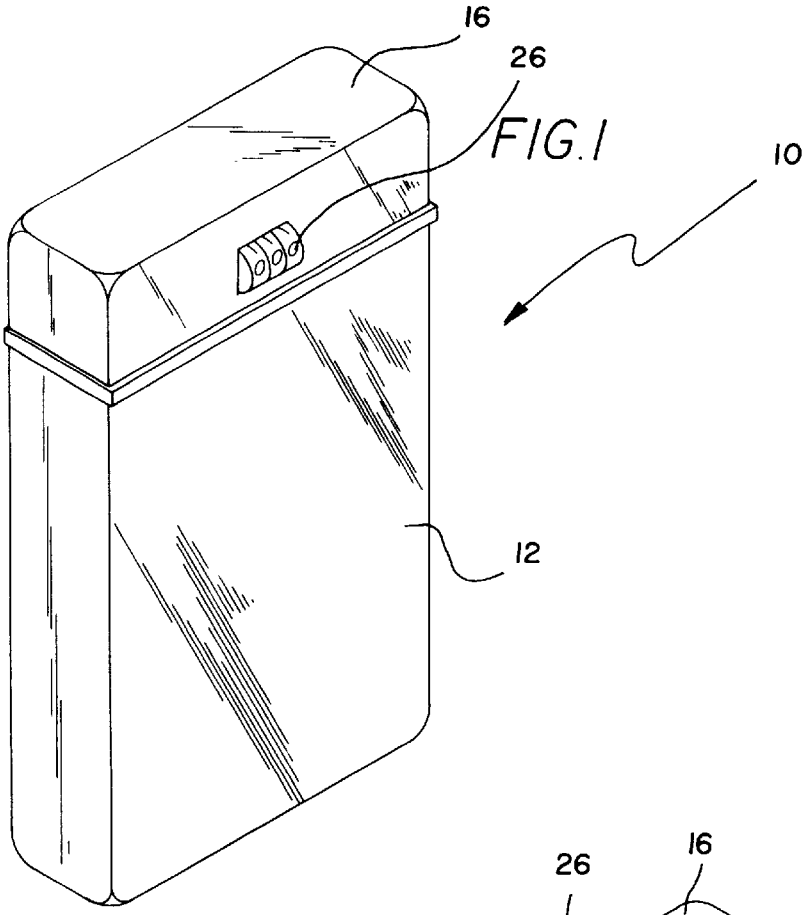
FIG. 1 perspective view of a new credit card security device according to the present invention.
Figure 2:
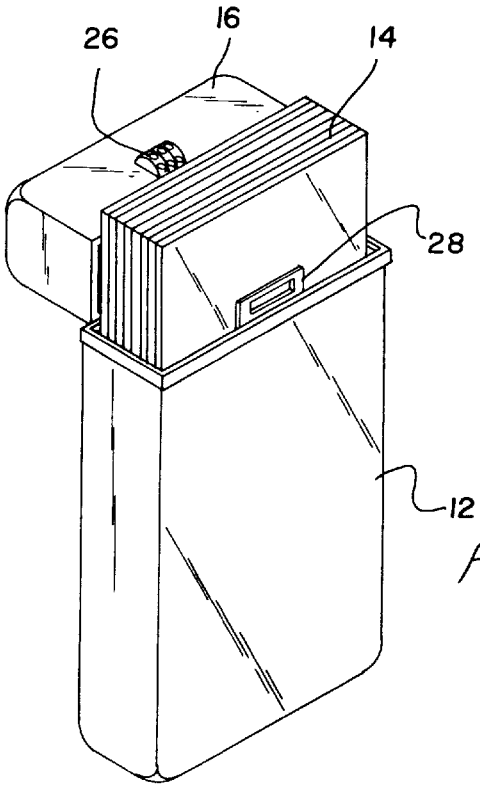
FIG. 2 perspective view of the present invention illustrated in an open orientation.

With reference now to the drawings, and in particular to FIGS. 1 through 4 thereof, a new credit card security device embodying the principles and concepts of the present invention and generally designated by the reference numeral 10 will be described.

As best illustrated in FIGS. 1 through 4, the credit card security device 10 comprises a housing 12 having a generally rectangular configuration. The housing 12 has an open upper end, a closed lower end, a wide front face, a wide rear face and opposed narrow side faces. The housing 12 is dimensioned for receiving credit cards 14 and identification cards therein. The open upper end has a cover 16 hingedly secured to a back edge thereof. The cover 16 is defined by an open lower end, a closed upper end, a front face, a rear face and opposed side faces.

An ink filled membrane 18 is disposed interiorly of the housing 12 and the cover 16. The membrane 18 is disposed along the front faces, the rear faces, and the opposed side faces of the housing 12 and the cover 16. The membrane 18 will break if met with limited resistance, such as a screwdriver or the like, attempting to pry the cover 16 open. Once the membrane 18 is broken, the ink 20 therein will seep out within the interior of the housing 12 and cover 16 thereby ruining the credit cards 14 and the identification cards. The ink will also seep outside of the housing 12 thereby coloring the tamperers hands. Note FIG. 4. Alternate forms of safety mechanisms could also be employed such as chemicals that would permanently disfigure the cards or a type of stun gas or audio alarm.

A lifting platform 22 is slidably disposed interiorly of the housing. The platform 22 has a pair of springs 24 secured to a lower surface thereof. Free ends of the springs 24 are secured to the closed lower end of the housing 12. Note FIG. 3. The lifting platform 22 will be pressed downwardly against the urging of the springs 24 when the credit cards 14 and identification cards are within the housing 12 and the cover 16 is in a closed orientation. Once the cover 16 is opened, the springs 24 will recoil thereby raising the lifting platform 22 upwardly to elevate the cards 14 above the open upper end of the housing 12 for easy retrieval by the user. Note FIG. 2.

A combination lock 26 is disposed within the front face of the cover 16. The combination lock 26 has a corresponding latch member 28 secured to and extending upwardly from the open upper end of the housing 12 for selectively engaging the combination lock 26 to preclude opening of the cover 16 with respect to the housing 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new credit card security device for securely housing credit cards and identification comprising, in combination:

a housing having a generally rectangular configuration, the housing having an open upper end, a closed lower end, a wide front face, a wide rear face and opposed narrow side faces, the housing being dimensioned for receiving credit cards and identification cards therein, the open upper end having a cover hingedly secured to a back edge thereof, the open upper end having a peripheral flange offset from the faces of the housing and extending upwardly for defining a peripheral recess, the cover being defined by an open lower end, a closed upper end, a front face, a rear face and opposed side faces, wherein the open lower end of the cover is defined by a lower peripheral edge for being releasably inserted within the peripheral recess;

an ink filled membrane of the housing and the cover, the membrane completely lining an interior surface of the front faces, the rear faces, and the opposed side faces of the housing and the cover for expelling ink to an exterior of the housing and cover further expelling ink to an interior of the housing and cover upon being broken to mark a hand of a person and further to destroy the cards;

a substantially planar lifting platform with a size and shape similar to that of the closed lower end of the housing, the lifting platform being slidably disposed interiorly of the housing for elevating cards positioned within the housing, the platform having a pair of springs secured to a lower surface thereof and further secured to the closed lower end of the housing; and a combination lock including a plurality of coaxially aligned dials disposed within the front face of the cover, the combination lock having a corresponding latch member secured to and extending upwardly from the open upper end of the housing in a substantially coplanar relationship with the front face of the housing for selectively engaging the combination lock to preclude opening of the cover with respect to the housing.

* * * * *